US010532237B2

(12) United States Patent
Reilly et al.

(10) Patent No.: US 10,532,237 B2
(45) Date of Patent: Jan. 14, 2020

(54) DUAL MODE AGENT DISCHARGE SYSTEM WITH MULTIPLE AGENT DISCHARGE CAPABILITY

(75) Inventors: William J. Reilly, Langhorne, PA (US); Lawrence W. Thau, Jr., Flemington, NJ (US)

(73) Assignee: Victaulic Company, Easton, PA (US)

( * ) Notice: Subject to any disclaimer, the term of this patent is extended or adjusted under 35 U.S.C. 154(b) by 1437 days.

(21) Appl. No.: 13/197,125

(22) Filed: Aug. 3, 2011

(65) Prior Publication Data

US 2012/0031632 A1 Feb. 9, 2012

Related U.S. Application Data

(60) Provisional application No. 61/370,998, filed on Aug. 5, 2010.

(51) Int. Cl.

| | |
|---|---|
| ***A62C 99/00*** | (2010.01) |
| ***A62C 31/02*** | (2006.01) |
| ***B05B 1/26*** | (2006.01) |
| ***B05B 7/06*** | (2006.01) |
| ***A62C 31/07*** | (2006.01) |

(52) U.S. Cl.

CPC ..... *A62C 99/0072* (2013.01); *A62C 31/02* (2013.01); *A62C 31/07* (2013.01); *B05B 1/265* (2013.01); *B05B 7/066* (2013.01)

(58) Field of Classification Search

CPC ..... A62C 99/0072; A62C 31/03; A62C 31/07; A62C 31/02; B05B 1/265; B05B 7/066; B05B 1/26; B05B 7/06

USPC ..... 239/518, 418, 424.5, 424, 412, 413, 239/416.4, 416.5, 416.2, 417.3, 423; 169/46, 9; 222/1, 394

See application file for complete search history.

(56) References Cited

U.S. PATENT DOCUMENTS

| | | | |
|---|---|---|---|
| 2,519,619 | A | 8/1950 | Yellott et al. |
| 3,070,313 | A | 12/1962 | Fortman |
| 3,084,874 | A | 4/1963 | Jones et al. |
| 3,108,749 | A | 10/1963 | Drayer et al. |
| 3,117,551 | A | 1/1964 | Fortman et al. |

(Continued)

FOREIGN PATENT DOCUMENTS

| | | |
|---|---|---|
| TW | 497482 | 8/2002 |
| WO | 0041769 | 7/2000 |

(Continued)

OTHER PUBLICATIONS

Author Unknown, Office Action, Notice of Reasons for Rejection, from Corresponding Japanese patent application No. 2013-523332; dated Oct. 11, 2013; pp. 1-2; Japanese Patent Office, Tokyo, Japan.

(Continued)

*Primary Examiner* — Alexander M Valvis
*Assistant Examiner* — Qingzhang Zhou
(74) *Attorney, Agent, or Firm* — Ballard Spahr LLP

(57) ABSTRACT

An emitter system capable of discharging an atomized liquid-gas stream or a liquid stream which atomizes into a spray has a source of pressurized gas and one or more sources of pressurized liquids. Flow of gas and liquid to an emitter is controlled by valves, and the emitter can be used to discharge either the atomized liquid-gas stream or the liquid stream. The emitter system may be used for fire suppression.

17 Claims, 7 Drawing Sheets

(56) References Cited

U.S. PATENT DOCUMENTS

| | | | | |
|---|---|---|---|---|
| 3,157,359 | A | 11/1964 | Fortman | |
| 3,297,255 | A | 1/1967 | Fortman | |
| 3,326,467 | A | 6/1967 | Fortman | |
| 3,371,869 | A | 3/1968 | Hughes | |
| 3,638,859 | A | 2/1972 | MacFarlane | |
| 3,741,484 | A | 6/1973 | Cresswell | |
| 3,779,460 | A | 12/1973 | Monro | |
| 3,829,015 | A | 8/1974 | Monro | |
| 3,923,248 | A | 12/1975 | Cresswell | |
| 3,934,641 | A | 1/1976 | Chielens | |
| 4,026,586 | A | 5/1977 | Kennedy, Jr. et al. | |
| 4,103,827 | A | 8/1978 | Kumazawa | |
| 4,109,862 | A | 8/1978 | Hughes | |
| 4,281,717 | A | 8/1981 | Williams | |
| 4,361,285 | A | 11/1982 | Koppehele et al. | |
| 4,408,719 | A | 10/1983 | Last | |
| 4,531,588 | A * | 7/1985 | Brunsicke | 169/9 |
| 4,871,489 | A | 10/1989 | Ketcham | |
| 5,221,026 | A | 6/1993 | Williams | |
| 5,248,087 | A | 9/1993 | Dressler | |
| 5,297,501 | A | 3/1994 | Lieberman et al. | |
| 5,314,117 | A | 5/1994 | Pavljuk et al. | |
| 5,405,085 | A | 4/1995 | White | |
| 5,495,893 | A | 3/1996 | Roberts et al. | |
| 5,687,905 | A | 11/1997 | Tsai | |
| 5,713,417 | A * | 2/1998 | Sundholm | 169/46 |
| 5,829,684 | A | 11/1998 | Fishcer | |
| 5,845,714 | A * | 12/1998 | Sundholm | 169/46 |
| 5,845,846 | A | 12/1998 | Watanabe et al. | |
| 5,983,944 | A | 11/1999 | Niv | |
| 6,009,869 | A | 1/2000 | Corbeil | |
| 6,065,546 | A | 8/2000 | Lockwood | |
| 6,173,790 | B1 | 1/2001 | Russwurm et al. | |
| 6,261,338 | B1 | 7/2001 | Mahoney et al. | |
| 6,302,450 | B1 | 10/2001 | Dole et al. | |
| 6,311,780 | B1 | 11/2001 | Zuev et al. | |
| 6,314,754 | B1 | 11/2001 | Kotliar | |
| 6,357,531 | B1 | 3/2002 | Asselin | |
| 6,390,203 | B1 * | 5/2002 | Borisov et al. | 169/62 |
| 6,401,487 | B1 | 6/2002 | Kotliar | |
| 6,418,752 | B2 | 7/2002 | Kotliar | |
| 6,478,240 | B1 | 11/2002 | Dorkin et al. | |
| 6,502,421 | B2 | 1/2003 | Kotliar | |
| 6,533,333 | B1 | 3/2003 | Radzik | |
| 6,557,374 | B2 | 5/2003 | Kotliar | |
| 6,560,991 | B1 | 5/2003 | Kotliar | |
| 6,662,549 | B2 | 12/2003 | Burns | |
| 6,742,721 | B2 | 6/2004 | Piper | |
| 6,749,027 | B1 * | 6/2004 | Crabtree | A62C 31/07 169/14 |
| 6,900,246 | B2 | 5/2005 | List et al. | |
| 7,080,793 | B2 | 7/2006 | Borisov et al. | |
| 7,111,975 | B2 | 9/2006 | Fenton et al. | |
| 7,201,234 | B2 | 4/2007 | Rogers et al. | |
| 7,216,722 | B2 | 5/2007 | Sharma et al. | |
| 7,686,093 | B2 | 5/2010 | Reilly et al. | |
| 7,721,811 | B2 * | 5/2010 | Reilly et al. | 169/37 |
| 7,726,408 | B2 | 6/2010 | Reilly et al. | |
| 2004/0188104 | A1 | 9/2004 | Borisov et al. | |
| 2004/0195364 | A1 | 10/2004 | Piper | |
| 2006/0113092 | A1 * | 6/2006 | Rogers et al. | 169/37 |
| 2006/0278410 | A1 | 12/2006 | Reilly et al. | |
| 2006/0278736 | A1 * | 12/2006 | Reilly | A62C 31/005 239/542 |
| 2008/0105442 | A1 | 5/2008 | Reilly et al. | |
| 2010/0038101 | A1 | 2/2010 | Terry et al. | |
| 2010/0181081 | A1 | 7/2010 | Reilly et al. | |

FOREIGN PATENT DOCUMENTS

| | | | | |
|---|---|---|---|---|
| WO | 03030995 | A2 | 4/2003 | |
| WO | WO2009041935 | * | 4/2009 | A62C 35/00 |

OTHER PUBLICATIONS

Yamamoto, Shusaku; English translation of Notice of Reasons for Rejection, from corresponding Japanese patent application No. 2013-523332; dated Oct. 11, 2013; pp. 1-3, Shusaku Yamamoto, Osaka, Japan.

Mohri, Mineko; PCT International Preliminary Report on Patentability regarding International Application No. PCT/US2011/046558; dated Feb. 5, 2013.

Copenheaver, Blaine R.; PCT International Search Report from corresponding International Patent Application No. PCT/US2011/046558; United States Patent and Trademark Office ISA/US; dated Dec. 27, 2011; pp. 1-2.

Copenheaver, Blaine R.; PCT Written Opinion of the International Searching Authority from corresponding International Patent Application No. PCT/US2011/046558; United States Patent and Trademark Office ISA/US; dated Dec. 27, 2011; pp. 1-9.

Nehrdich, Martin; Supplementary European Search Report and Written Opinion; dated Jul. 7, 2014; pp. 1-5; European Patent Office; Munich, Germany.

Author Unknown, Search Report from corresponding ROC (Taiwan) patent application No. 100128049; p. 1; dated May 18, 2014.

* cited by examiner

DUAL MODE AGENT DISCHARGE SYSTEM WITH MULTIPLE AGENT DISCHARGE CAPABILITY

CROSS REFERENCE TO RELATED APPLICATION

This application is based upon and claims priority to U.S. Provisional Application No. 61/370,998 filed Aug. 5, 2010, which provisional application is hereby incorporated by reference in its entirety.

FIELD OF THE INVENTION

This invention concerns fluid agent discharge systems using devices configured to sequentially emit an atomized liquid-gas stream and another fluid agent, such as a gas, a liquid spray or a foam, for various applications such as suppressing a fire. The invention also encompasses methods for operating such systems, as well as emitters which can discharge two different fluid agents in sequence, and methods for operating such emitters.

BACKGROUND OF THE INVENTION

Systems for atomizing and emitting liquids entrained in a liquid-gas stream find extensive use in various applications, notably fire suppression. Examples of such systems and their components are disclosed in U.S. Pat. No. 7,726,408 to Reilly et al. (hereby incorporated by reference), U.S. Pat. No. 7,686,093 to Reilly et al. (hereby incorporated by reference) and U.S. Pat. No. 7,721,811 to Reilly et al. (hereby incorporated by reference).

Such systems require a supply of pressurized gas for atomization and discharge, and the volume of available gas is often limited by practical considerations such as cost, tankage, and compressor volume flow rate. It is conceivable that the available gas may be exhausted during system use, thereby leaving the structure unprotected against re-ignition of the fire, or vulnerable to a second fire, until the system can be recharged with gas.

In one particular example, water based fire control and suppression sprinkler systems may be used to suppress fires which form in the presence of water soluble combustible liquids, such as ethylene oxide. Of particular concern is the suppression of fires which occur in storage facilities, such as within a bunker or tank holding the liquid. Such a system may generally include a plurality of individual sprinkler heads which are mounted within the tank or bunker in the gas space above the liquid level. The sprinkler heads are normally maintained in a closed condition and include a thermally responsive sensing member to determine when a fire condition has occurred within the bunker. Upon actuation of the thermally responsive member or members, the sprinkler heads open, permitting pressurized water at each of the sprinkler heads to freely flow therethrough for extinguishing the fire.

When actuated, traditional sprinkler heads release a spray of fire suppressing liquid, such as water, onto the area of the fire. The water spray, while somewhat effective, has several disadvantages. For example, the water spray exhibits limited modes of fire suppression. The spray, being composed of relatively large droplets providing a small total surface area, does not efficiently absorb heat and therefore cannot operate efficiently to prevent spread of the fire by lowering the temperature of the ambient air around the fire within the bunker. Large droplets also do not block radiative heat transfer effectively, thereby allowing the fire to spread by this mode. The spray furthermore does not efficiently displace oxygen from the ambient air at the liquid surface, nor is there usually sufficient downward momentum of the droplets to overcome the fire plume and attack the base of the fire. For these reasons atomizing systems, as described above, are advantageous in such applications, as they remedy the deficiencies of the simple water spray systems. However, should the atomizing system prematurely exhaust its gas supply, or exhaust its gas supply and have no means for safeguarding against re-ignition of the fire, it would be advantageous to be able to employ a back-up system, which does not suffer from the disadvantage of a limited gas supply for atomization and discharge.

For water soluble flammable liquids, it is further advantageous, once the fire is out, to supply diluting water to the bunker which will change the concentration of the liquid and render it non-flammable. This will prevent the fire from re-igniting. Sprinklers alone typically used in fire suppression systems simply do not have a rate of flow which makes this feature practical when a bunker or tank having a significant volume is considered.

There is clearly a need for a fire suppression system which operates in multiple fire suppression modes and which would be able to effectively fight a fire in atomization mode and also deliver a sufficient quantity of fire suppressing liquid, or other suppressant, such as foam or gas, as a back-up to prevent re-ignition of a fire and provide protection after the atomizing gas supply is exhausted.

SUMMARY OF THE INVENTION

One example embodiment of the invention concerns an emitter system comprising at least one emitter. The emitter comprises a nozzle having a nozzle inlet and a nozzle outlet. A duct, separate from the nozzle, has a duct inlet, and a duct outlet. The duct outlet is separate from and positioned adjacent to the nozzle outlet. A deflector having a deflector surface is positioned facing the nozzle outlet.

The example emitter system further comprises a source of pressurized gas connectable in fluid communication with the nozzle inlet, and a source of pressurized liquid connectable alternately with one of the duct inlet and the nozzle inlet. When the source of pressurized gas is connected with the nozzle inlet in combination with connecting the source of pressurized liquid with the duct inlet, the emitter discharges an atomized liquid-gas stream from the emitter; whereas connecting the source of pressurized liquid to the nozzle inlet results in discharge of a liquid stream from the nozzle.

In a particular practical example the emitter system comprises a first conduit providing fluid communication between the source of pressurized gas and the nozzle inlet and a first valve positioned within the first conduit for connecting the source of pressurized gas with the nozzle inlet. A second conduit provides fluid communication between the source of pressurized liquid and the duct inlet. A second valve is positioned within the second conduit for connecting the source of pressurized liquid with the duct inlet.

In one embodiment a third conduit provides fluid communication between the second valve and the first conduit. The second valve is adjustable in one of three configurations so as to:

a) prevent fluid communication between the source of pressurized liquid and both the nozzle inlet and the duct inlet;

b) connect the source of pressurized liquid in fluid communication only with the duct inlet; or c) connect the source of pressurized liquid in fluid communication with the nozzle inlet.

In an alternate embodiment, a third conduit provides fluid communication between the source of pressurized liquid and the nozzle inlet, and a third valve is positioned within the third conduit for connecting the source of pressurized liquid with the nozzle inlet.

The invention also encompasses a fire suppression system, comprising at least one emitter. In an example fire suppression system the emitter comprises a nozzle having a nozzle inlet and a nozzle outlet. A duct, separate from the nozzle has a duct inlet and a duct outlet. The duct outlet is separate from and positioned adjacent to the nozzle outlet. A deflector having a deflector surface is positioned facing the nozzle outlet.

The fire suppression system further comprises a source of pressurized gas connectable in fluid communication with the nozzle inlet, and a source of pressurized liquid extinguishing agent connectable alternately with one of the duct inlet and the nozzle inlet. When the source of pressurized gas is connected with the nozzle inlet in combination with connecting the source of pressurized liquid extinguishing agent with the duct inlet an atomized liquid-gas stream is discharged from the emitter; whereas connecting the source of pressurized liquid extinguishing agent to the nozzle inlet results in discharge of a liquid extinguishing agent stream from the nozzle.

In a practical example, the fire suppression system according to the invention also comprises a first conduit providing fluid communication between the source of pressurized gas and the nozzle inlet. A first valve is positioned within the first conduit for connecting the source of pressurized gas with the nozzle inlet. A second conduit provides fluid communication between the source of pressurized liquid extinguishing agent and the duct inlet. A second valve is positioned within the second conduit for connecting the source of pressurized liquid extinguishing agent with the duct inlet.

In one embodiment, the fire suppression system may comprise a third conduit providing fluid communication between the second valve and the first conduit. The second valve is adjustable in one of three configurations so as to:

a) prevent fluid communication between the source of pressurized liquid extinguishing agent and both the nozzle inlet and the duct inlet;

b) connect the source of pressurized liquid extinguishing agent in fluid communication only with the duct inlet; or c) connect the source of pressurized liquid extinguishing agent in fluid communication with the nozzle inlet.

The example fire suppression system may further comprise a fire detection device positioned proximate to the emitter, and a control system in communication with the first and second valves and the fire detection device. The control system receives signals from the fire detection device and:

a) opens the first valve and adjusts the second valve to connect the source of pressurized liquid extinguishing agent in fluid communication only with the inlet duct to discharge the atomized liquid-gas stream from the at least one emitter; or b) adjusts the second valve to connect the source of pressurized liquid extinguishing agent in fluid communication with the nozzle inlet to discharge the liquid extinguishing agent stream from the nozzle.

The invention also encompasses a method of operating an emitter adapted to operate in two different modes. The emitter comprises a nozzle having a nozzle inlet and a nozzle outlet and a duct, separate from the nozzle. The duct has a duct inlet, and a duct outlet separate from and positioned adjacent to the nozzle outlet. A deflector having a deflector surface is positioned facing the nozzle outlet.

The method comprises:

selecting a mode of operation from the group consisting of:

a) discharging a liquid stream from the emitter and b) discharging an atomized liquid-gas stream from the emitter.

In one embodiment, discharging the liquid stream from the emitter comprises:

connecting the nozzle inlet in fluid communication with a pressurized source of the liquid; and discharging the liquid from the nozzle outlet.

The method further comprises breaking the liquid stream into a spray by impinging the liquid stream on a plurality of projections extending outwardly from the deflector surface.

In the example method, discharging an atomized liquid-gas stream from the emitter comprises:

connecting the nozzle inlet in fluid communication with a pressurized source of gas;

connecting the duct inlet in fluid communication with a pressurized source of a liquid;

discharging the gas from the nozzle outlet;

discharging the liquid from the duct outlet;

entraining the liquid in the gas to form a liquid-gas stream; and projecting the liquid-gas stream from the emitter.

The invention further includes a method of operating a fire suppression system having an emitter adapted to operate in two different modes. In one example embodiment the emitter comprises a nozzle having a nozzle inlet and a nozzle outlet and a duct, separate from the nozzle. The duct has a duct inlet, and a duct outlet separate from and positioned adjacent to the nozzle outlet. A deflector having a deflector surface is positioned facing the nozzle outlet.

The method comprises selecting a mode of operation from the group consisting of:

a) discharging a fire suppressing liquid stream from the emitter and b) discharging a fire suppressing atomized liquid-gas stream from the emitter.

Discharging the fire suppressing liquid stream from the emitter comprises:

selecting a fire suppressing liquid;

connecting the nozzle inlet in fluid communication with a pressurized source of the selected fire suppressing liquid; and discharging the selected fire suppressing liquid from the nozzle outlet.

The method may further comprise breaking the fire suppressing liquid stream into a spray by impinging the fire suppressing liquid stream on a plurality of projections extending outwardly from the deflector surface.

Discharging a fire suppressing atomized liquid-gas stream from the emitter comprises:

connecting the nozzle inlet in fluid communication with a pressurized source of gas;

selecting a fire suppressing liquid;

connecting the duct inlet in fluid communication with a pressurized source of the fire suppressing liquid;

discharging the gas from the nozzle outlet;

discharging the fire suppressing liquid from the duct outlet;

entraining the fire suppressing liquid in the gas to form the fire suppressing atomized liquid-gas stream; and projecting the fire suppressing atomized liquid-gas stream from the emitter.

The invention also encompasses an emitter. An example emitter comprises nozzle having a nozzle inlet and a nozzle outlet. A duct, separate from the nozzle, has a duct inlet, and a duct outlet separate from and positioned adjacent to the nozzle outlet. A deflector having a deflector surface is positioned facing the nozzle outlet. The deflector surface is positioned in spaced relation to the nozzle outlet and has a first surface portion comprising a flat surface oriented substantially perpendicularly to a gas flow from the nozzle outlet and a second surface portion oriented non-perpendicularly to the gas flow from the nozzle outlet. A plurality of projections extend outwardly from the deflector.

In one embodiment the projections are located in a plane and extend substantially radially outwardly from the deflector. The plane may be oriented substantially perpendicularly to the gas flow from the nozzle. The projections may be positioned downstream of the second surface portion.

DETAILED DESCRIPTION OF THE EMBODIMENTS

Figure 1:
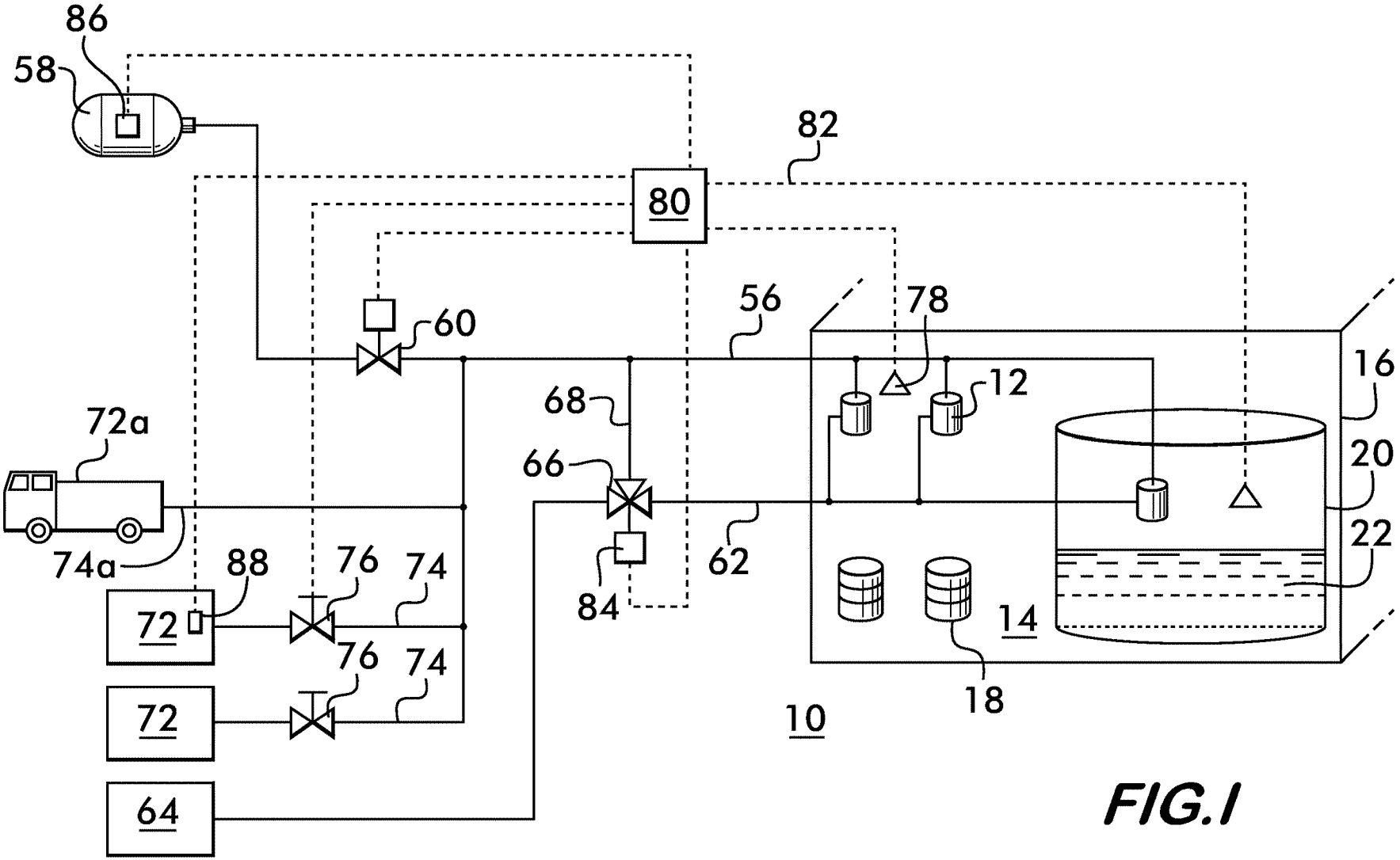
FIGS. 1 and 1A are schematic diagrams illustrating example emitter systems, in these examples, fire suppression systems, according to the invention.

FIG. 1 illustrates, in schematic form, an example emitter system 10 according to the invention. In this example, the emitter system is a fire suppression system. System 10 includes at least one, but preferably a plurality of high velocity low pressure emitters 12, described in detail below. In this example, emitters 12 are arranged in a fire hazard zone 14, which may be, for example a warehouse 16 in which flammable items 18 are stored. Fire hazard zone 14 may also be a bunker 20 which holds a flammable liquid 22.

Figure 2:
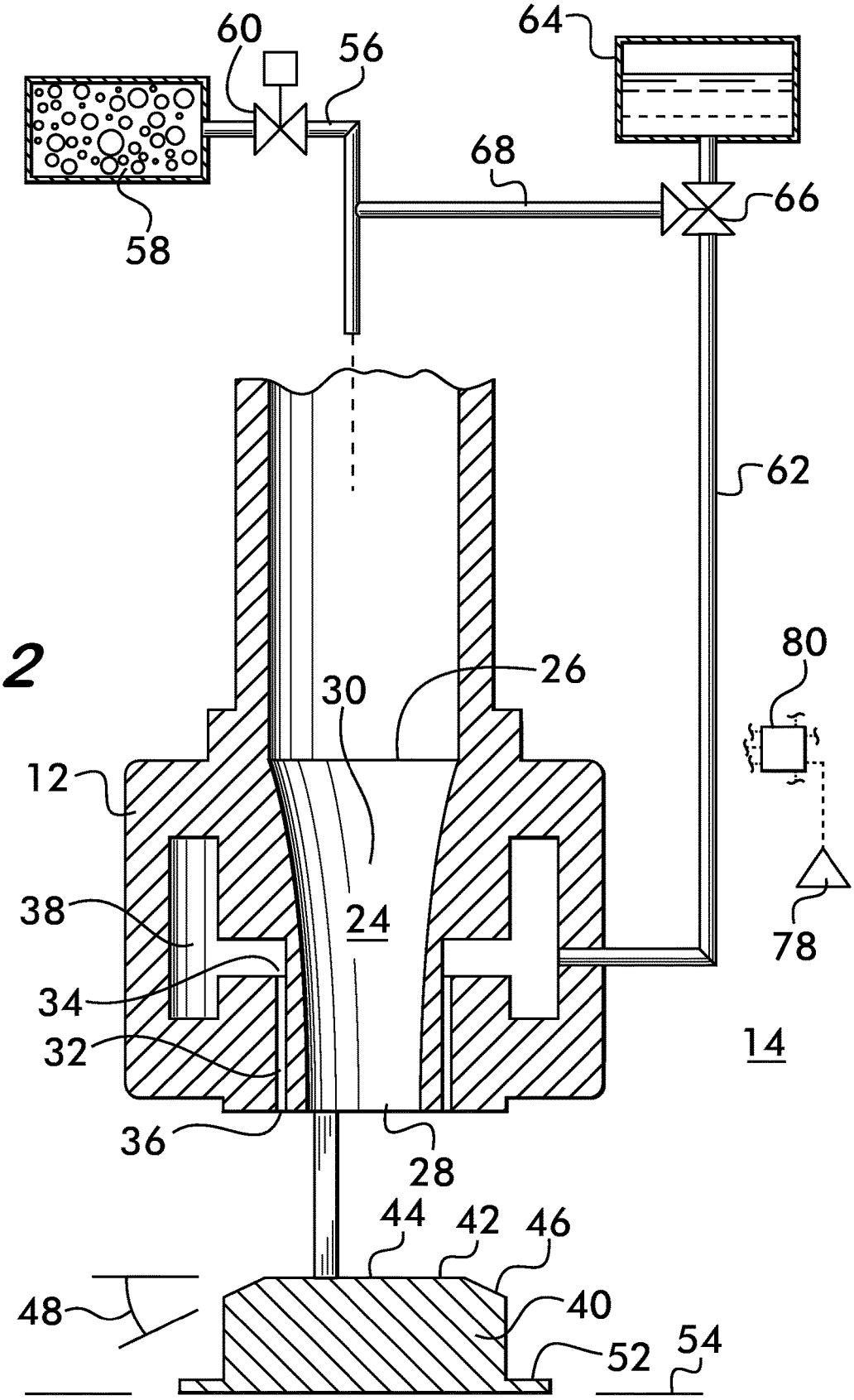
FIGS. 2 and 2A are longitudinal sectional views of a high velocity low pressure emitter used in the fire suppression systems shown in FIGS. 1 and 1A, respectively.

As shown in FIG. 2, emitters 12 comprise a nozzle 24 having a nozzle inlet 26 and a nozzle outlet 28. The nozzle bore 30 is unobstructed between the nozzle inlet 26 and the nozzle outlet 28. A duct 32, separate from the nozzle, has a duct inlet 34 and a duct outlet 36. The duct outlet 36 is separate from and positioned adjacent to the nozzle outlet 28. There are preferably a plurality of ducts 32 surrounding the nozzle 24, and the inlets 34 of the ducts may be in fluid communication with a chamber 38 surrounding the nozzle 24 and forming a manifold to feed all of the ducts with a fluid as explained below.

Figure 4:
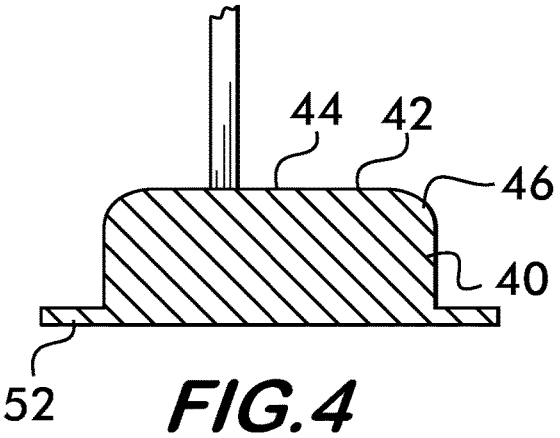
FIGS. 4-7 are longitudinal sectional views showing alternate embodiments of the component shown in FIG. 3.
Figure 5:
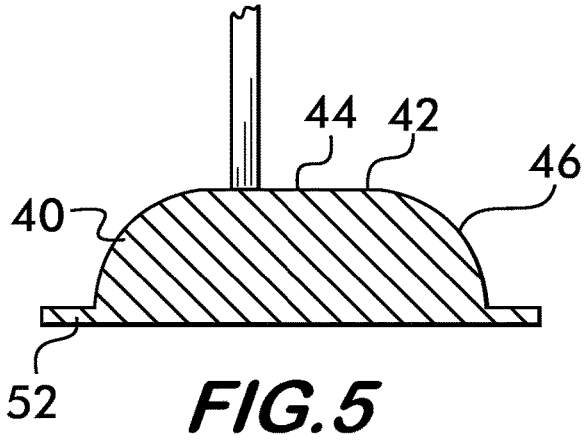
Figure 6:
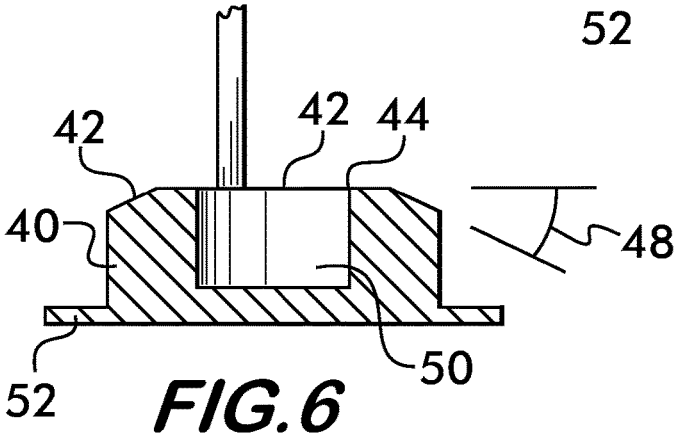
Figure 7:
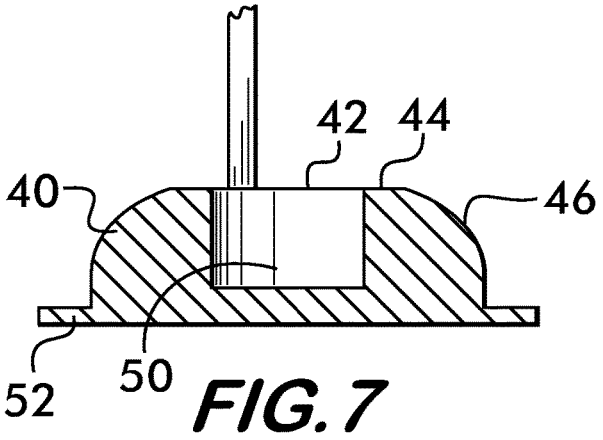

A deflector 40 has a deflector surface 42 which is positioned facing the nozzle outlet 28 and in spaced relation to it. In the example embodiment shown, the deflector surface 42 has a first, flat surface portion 44 oriented substantially perpendicularly to a gas flow from the nozzle outlet 28. It is found advantageous if the minimum diameter of the flat surface portion is approximately equal to the diameter of the nozzle outlet 28. A second surface portion 46 surrounds the flat surface portion 44 and is oriented non-perpendicularly to the gas flow from the nozzle outlet. In the example shown in FIG. 2, the second surface portion 46 is angularly oriented, having a sweep back angle 48 between about 15° and about 45° as measured from the first, or flat surface portion 44. Other configurations of the second, non-perpendicular surface portion 46 are shown in FIGS. 4 and 5 where the second surface portion 46 is curved. As shown in FIGS. 6 and 7, the deflector 40 may also have a closed end cavity 50 facing the nozzle outlet 28.

Figure 3:
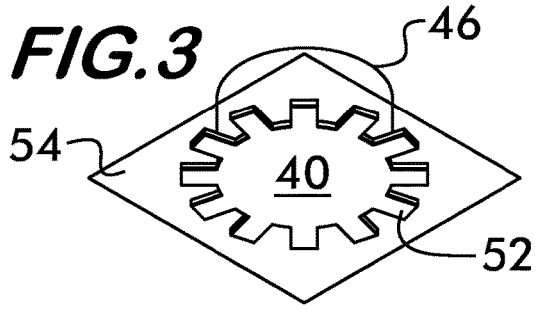
FIG. 3 is an isometric view of a component of the emitter shown in FIG. 2.

As shown in FIGS. 2 and 3, the deflector 40 also has a plurality of outwardly extending projections 52. Preferably, the projections 52 are located in a plane 54 and extend radially outwardly therefrom. It is advantageous to orient the plane 54 substantially perpendicular to the gas flow from the nozzle outlet 28. The projections provide an atomizing effect by breaking a liquid stream discharged from the nozzle outlet 28 into a liquid spray when the liquid stream impinges on the projections 52 as described below. In FIGS. 2 and 3 the projections 52 are shown positioned downstream of the second surface portion 46.

With reference again to FIGS. 1 and 2, a first conduit 56 provides fluid communication between the nozzle inlet 26 of emitters 12 and a source of pressurized gas 58, which could be, for example, a tank, a compressor, or a combination tank and compressor. Gases of interest for a fire suppression system include air, nitrogen, carbon dioxide, argon, and mixtures of such gases. A first valve 60 is positioned within the first conduit for connecting pressurized gas source 58 with the nozzle inlet 26, connection being effected when the first valve 60 is opened. A second conduit 62 provides fluid communication between a source of pressurized liquid 64 and the duct inlet 34. A second valve 66 is positioned within the second conduit 62 for connecting pressurized liquid source 64 with the duct inlet 34, connection being effected when the second valve 66 is opened. For a fire suppression system the pressurized liquid comprises a liquid extinguishing agent such as water, foam, liquefied halocarbons as well as water with additives which modify water's heat absorbing characteristics, such as surfactants.

Second valve 66 may be a three way valve and a third conduit 68 provides fluid communication between the second valve 66 and the first conduit 56. Connection to the first conduit 56 is preferably made between the first valve 60 and the emitters 12. In this embodiment the second valve 66 is adjustable in one of three configurations. In a first configuration, second valve 66 is closed to prevent fluid communication between the source of pressurized liquid 64 and both the nozzle inlet 26 and the duct inlet 34. In a second configuration, second valve 66 is adjusted to connect the source of pressurized liquid 64 in fluid communication only with the duct inlet 34. In a third configuration, second valve 66 is adjusted to connect the source of pressurized liquid 64 with the nozzle inlet 26.

Figure 1A:
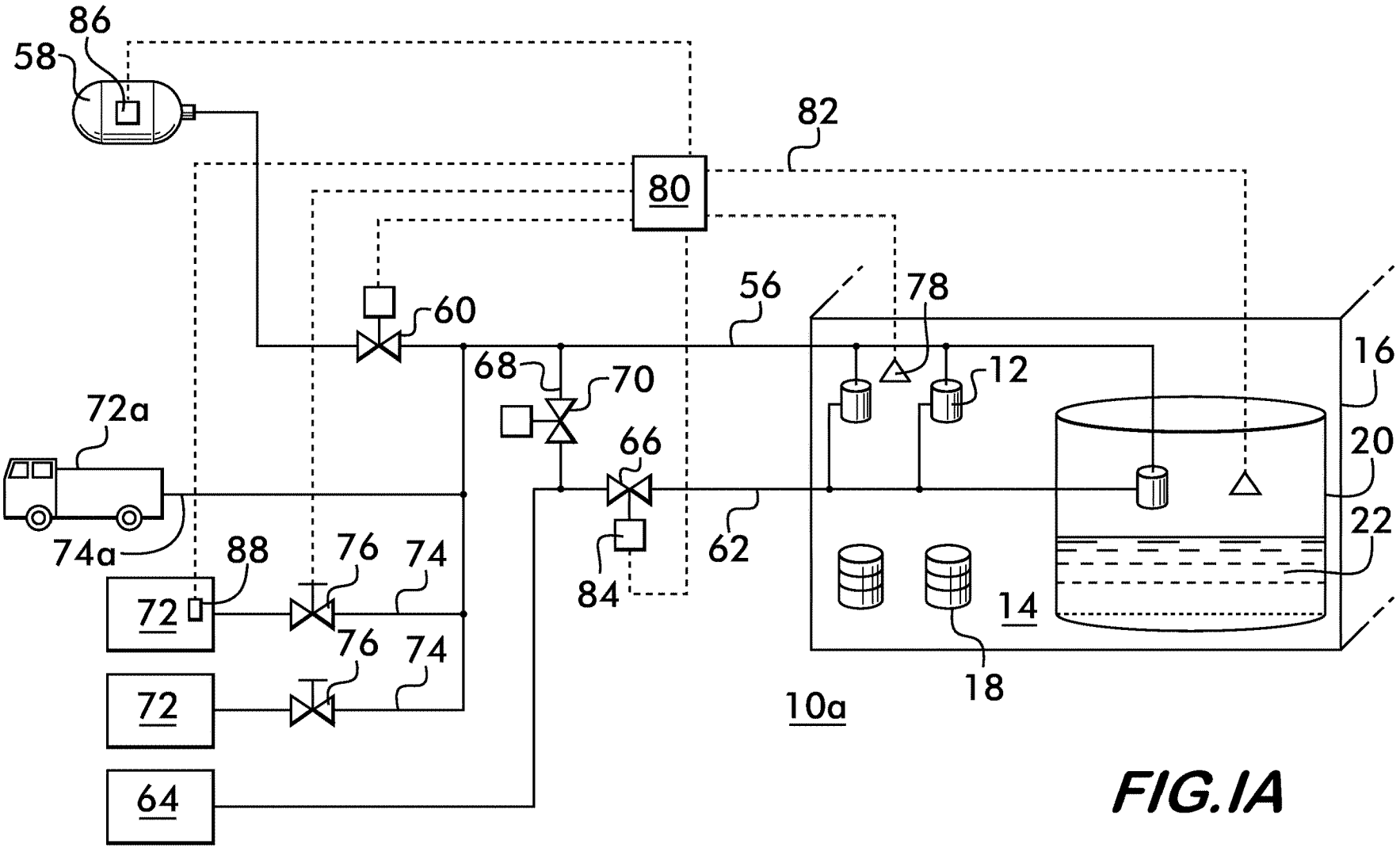
Figure 2A:
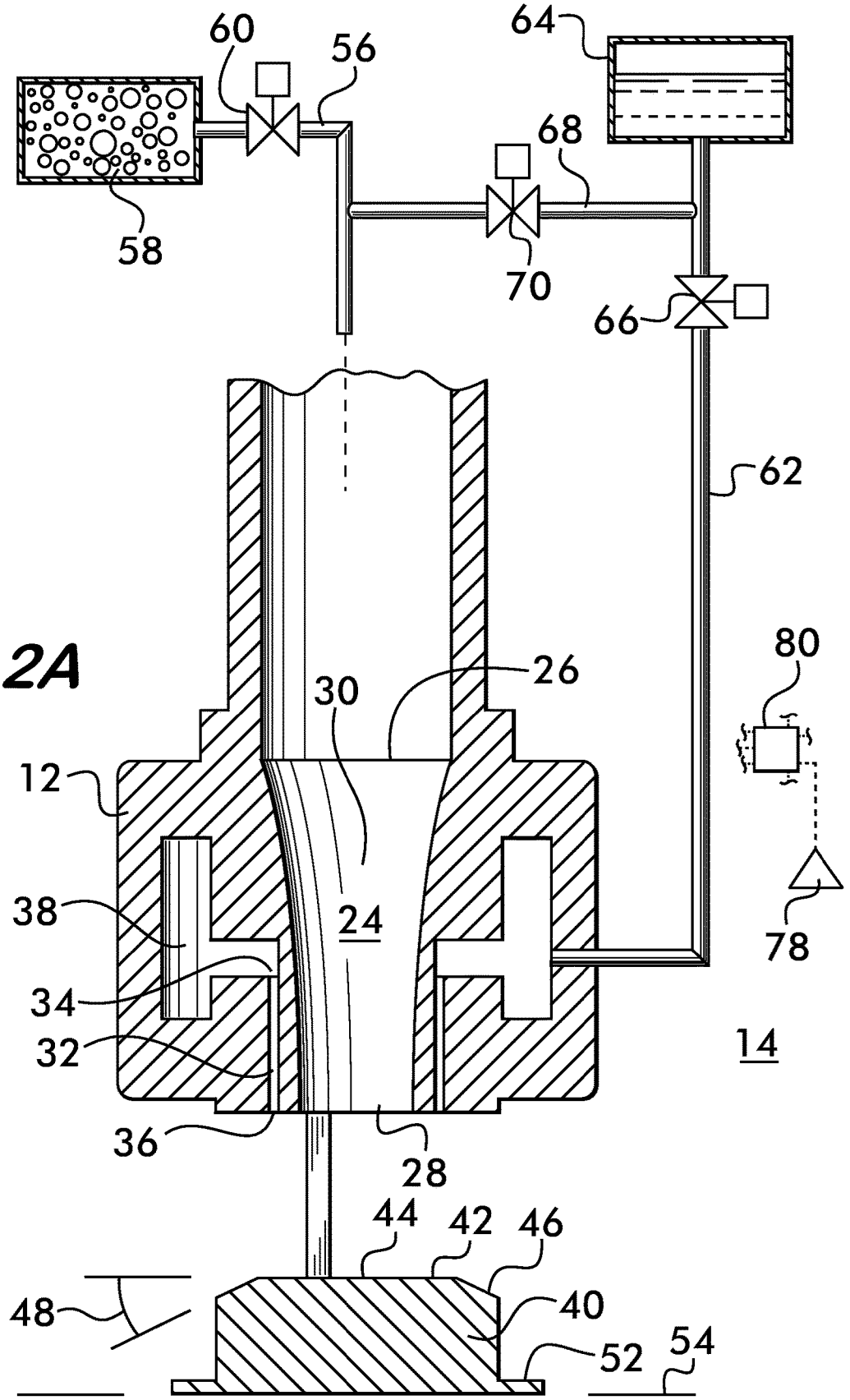

In another emitter system embodiment 10*a*, illustrated in FIGS. 1A and 2A, the third conduit 68 provides fluid communication between the source of pressurized liquid 64 and the first conduit 56, there being a third valve 70 positioned within the third conduit 68 which effects fluid communication between the source of pressurized liquid 64 and the first conduit 56 when the third valve is open. Note that it is advantageous to effect connection of the third conduit 68 to the first conduit 56 between the first valve 60 and the emitters 12.

As shown in FIGS. 1 and 1A, the emitter systems 10 and 10*a* may have a plurality of additional sources of pressurized liquid 72 connectable in fluid communication with the nozzle inlet 26. Each additional source of pressurized liquid 72 has respective conduit 74 to provide fluid communication with the first conduit 56, and a respective valve 76 is positioned within each respective conduit 74 to effect connection between an additional source of pressurized liquid 72 and the first conduit 56 when the valve 76 is opened. One of the additional sources of pressurized liquid 72 could be a fire engine pumper truck 72*a*, which can connect to a specially adapted conduit 74*a*.

As shown in FIG. 1, when configured as a fire suppression system, the emitter system 10 also includes one or more fire detection devices 78 positioned in the fire hazard zone 14 proximate to the emitters 12. These detection devices operate in any of the various known modes for fire detection, such as sensing of flame, heat, rate of temperature rise, smoke detection or combinations thereof.

The system components, namely, the valves 60, 66 70 and 76 may be coordinated and controlled by a control system 80, which may comprise, for example, a microprocessor having a control panel display and resident software. The control system 80 communicates with the system components over communication lines 82 to receive information, such as signals from the fire detection devices 78 indicative of a fire, signals from transducers, such as position encoders 84 associated with the various valves and indicative of the valve status as open or closed, as well as pressure transducers 86 indicative of the availability of pressurized gas, and liquid level transducers 88 indicative of the availability of pressurized liquid. Communication lines 82 may be hardwired or may use wireless technology to communicate the signals between the transducers and the control system. The control system 80 also issues control commands to remotely open and close the various valves 60, 66, 70 and 76 during system operation. Note also that the various valves could also be manually operated as needed for system operation.

Emitter systems 10 and 10*a* are capable of operating in at least two distinct modes of operation. In one mode, the emitters 12 discharge an atomized liquid-gas stream. In another mode, a liquid stream is discharged from the nozzle. This liquid stream may be atomized to form a spray by impingement on projections 52 extending from the deflector 40 as noted above. As an example of emitter system operation, the operation of fire suppression system 10 is described below.

As shown in FIGS. 1 and 2, source of pressurized gas 58 is charged with gas and first valve 60 is closed, preventing fluid communication between gas source 58 and nozzle inlet 26. Similarly, pressurized water or other fire extinguishing agent is available from pressurized liquid source 64. Second valve 66 is adjusted to prevent fluid communication between the pressurized liquid source 64 and both the nozzle inlet 26 and the duct inlet 34 of the emitters 12. Fire detection devices 78 are active and ready to generate and transmit signals to the control system 80 in the event of a fire in the fire hazard zone 14. This status information concerning the gas, liquid, states of the various valves and the fire detection devices is communicated over communications lines 82 from transducers described above to the control system 80 which uses the information to control the emitter system 10 according to algorithms in its resident software.

Figure 8:
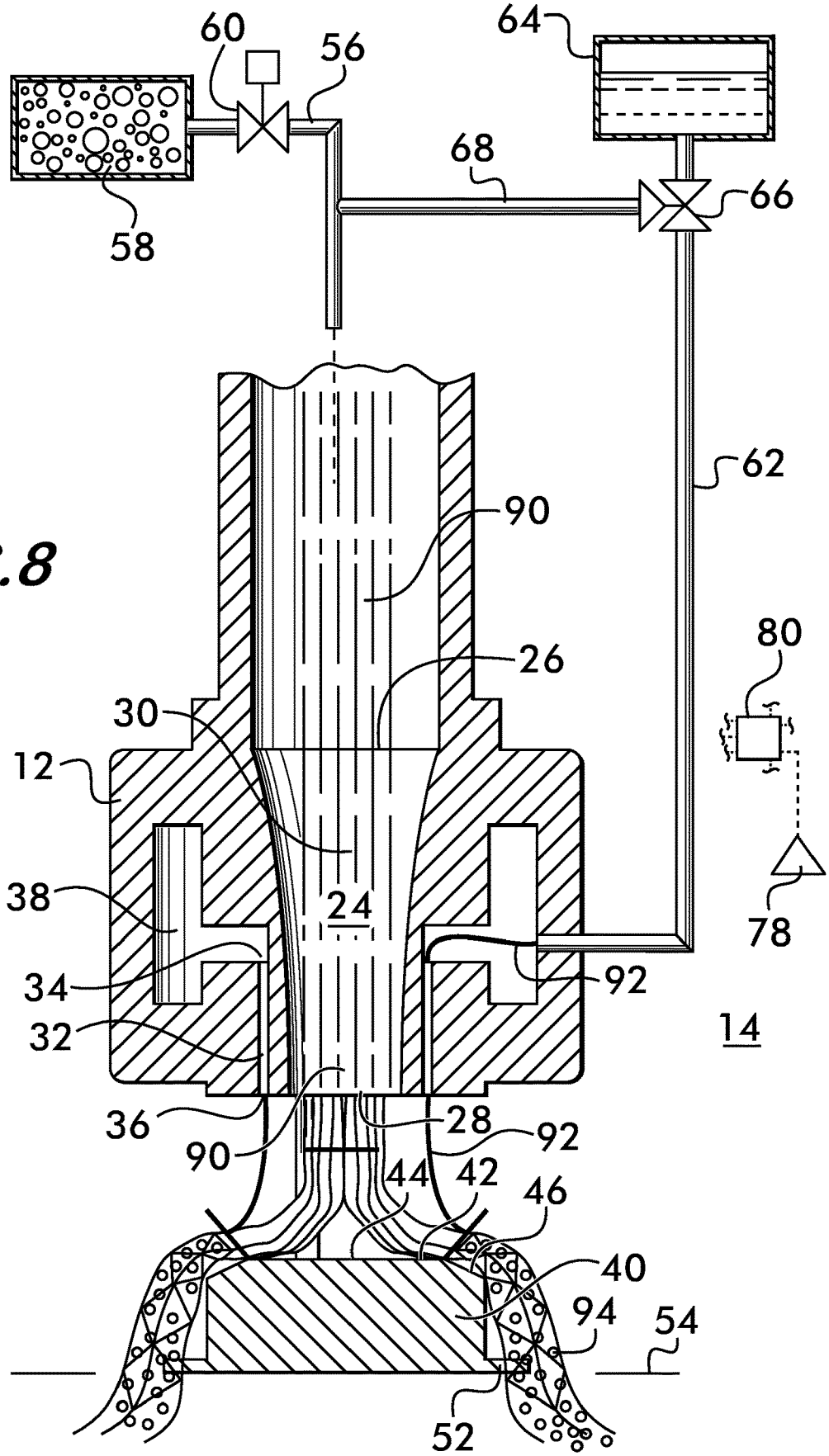
FIG. 8 illustrates discharge of an atomized liquid-gas stream from the emitter shown in FIG. 2.

When a fire in hazard zone 14 is detected by one or more of the detection devices 78, a signal or signals indicative of the fire are sent from the devices to the control system 80. The control system then selects a mode of operation for the emitter system. In this example, the control system first selects discharging an atomized liquid-gas stream from the emitters. To that end, as illustrated in FIG. 8, the control system 80 opens first valve 60 which connects the nozzle inlet 26 in fluid communication with the source of pressurized gas 58, thereby allowing the gas to flow through the first conduit 56 to the nozzle 24. The gas, symbolized by streamlines 90, is discharged from the nozzle at nozzle outlet 28 and impinges on the deflector 40. The control system 80 also adjusts the second valve 66 to connect the source of pressurized liquid 64 with the duct inlet 34. This allows pressurized liquid, in this example, water, to flow through the second conduit 62 to the duct 32. The liquid, represented by streamlines 92, is discharged from the duct outlet 36 and entrained in the gas to form the atomized liquid-gas stream 94. A detailed description of an example emitter useable in the emitter system 10 according to the invention may be found in U.S. Pat. No. 7,721,811 to Reilly et al., which patent has been incorporated by reference herein.

Figure 9:
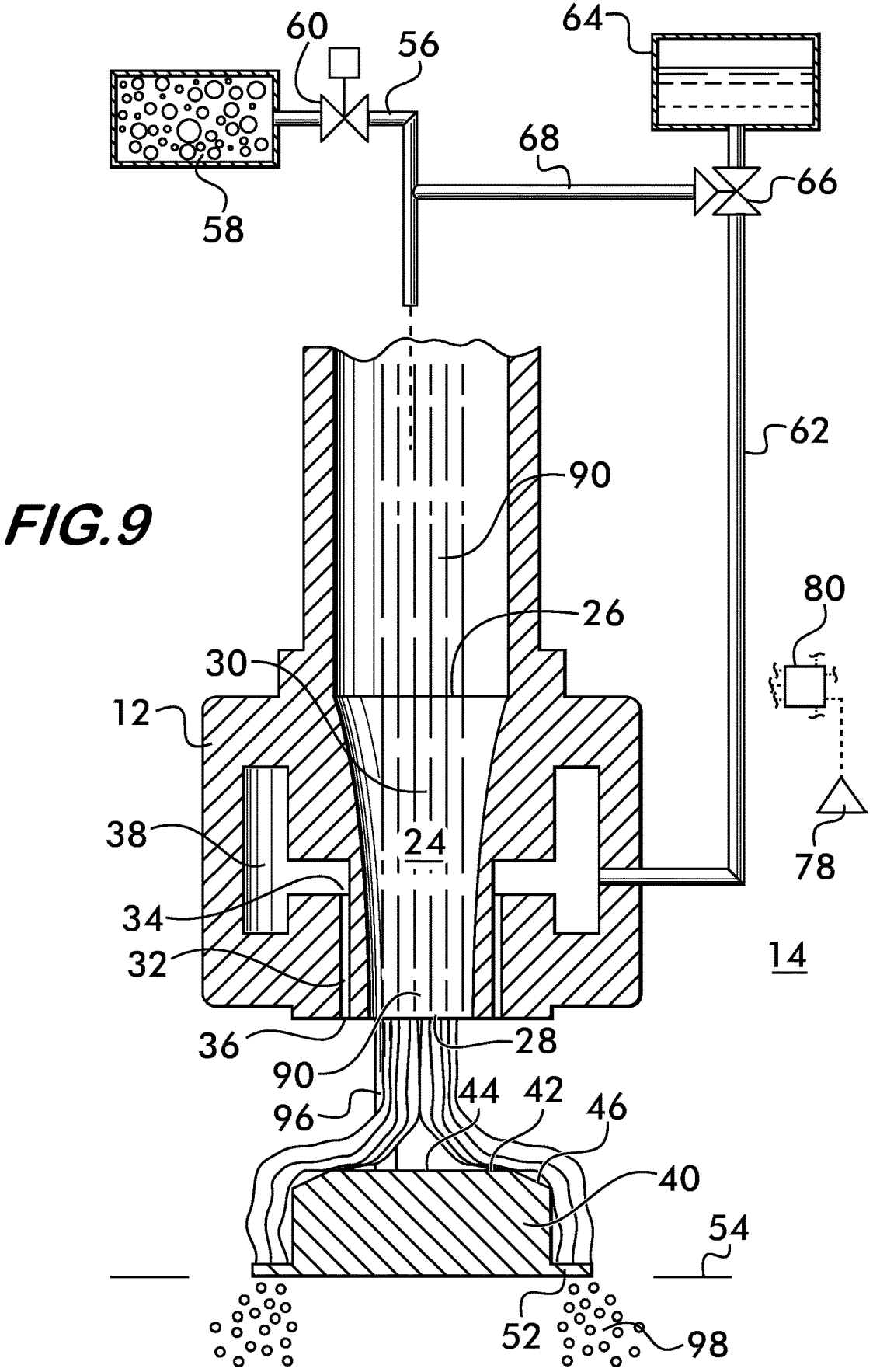
FIG. 9 illustrates discharge of a liquid stream from the emitter nozzle, the stream being atomized into a spray by impingement on projections extending from a deflector.

Once the fire is extinguished, the control system 80 receives signals to that effect from the fire detection devices 78. In response, the control system closes the first and second valves 60 and 66 to halt the discharge of the atomized liquid-gas stream from the emitters 12. The fire detection devices 78 continue to monitor the state of the fire hazard zone 14 however. If the original fire reignites, or if a second fire starts, the control system 80 is signaled by the devices 78 and again selects the mode of operation for the system 10. In this example, let us assume that the pressurized gas source 58 had been exhausted in fighting the first fire occurrence. The control system 80 knows this from the signals sent by the pressure transducer 86, which monitors the gas pressure within the source 58. This gas source has a finite capacity, and the system provides a way of fighting a reignited fire, or a separate fire which may occur later but before the gas source 58 can be recharged. In this situation, with no pressurized gas available during a fire, the control system selects discharging a liquid stream from the emitters. To that end the control system 80 adjusts the second valve 66 to connect the source of pressurized liquid 64 with the nozzle inlet 26. This permits liquid from the liquid source 64 to flow thorough the third conduit 68 and into the first conduit 56 where it is conducted to the nozzle 24. As shown in FIG. 9, the liquid stream, represented by streamlines 96, is discharged from the nozzle outlet 28 and impinges on the deflector 40. The projections 52 extending from the deflector serve to atomize the stream 96 into a spray 98 which extinguishes the fire. When in this mode of operation the emitter according to the invention meets NFPA 13 criteria for sprinkler discharge. The source of pressurized liquid 64 may be virtually inexhaustible, as for example when source 64 are the water service mains for a building or warehouse.

Alternately, the control system 80 may select another source of pressurized liquid 72 to discharge from nozzles 24 of the emitters 12. This provides options for fire suppressing agents other than water, for example, foams, or water modified by additives which increase its heat absorbing characteristics. Control system 80 selects these agents by opening one or more of valves 76 (see FIG. 1) to connect these additional sources 72 with nozzle inlet 26 by permitting the liquid to flow through conduit 74 and into the first conduit 56. The valves 76 may also be manually operated, as would be the case if a fire engine pumper truck 72*a* were selected to supply water to the nozzles 24.

In the alternate system embodiment 10*a* shown in FIG. 1A, the mode of system operation is selected by opening either the second valve 66 or the third valve 70. If it is desired to discharge an atomized liquid-gas stream then first valve 60 is opened along with second valve 66. As shown in FIG. 2A, opening first valve 60 connects the pressurized gas source 58 in fluid communication with nozzle inlet 26, and opening second valve 66 connects the pressurized liquid source 64 with the duct inlet 34, resulting in the atomized liquid-gas stream being discharged. If it is desired to discharge a liquid stream from the nozzle, then only the third valve 70 is opened. This connects the nozzle inlet 26 in fluid communication with the source of pressurized liquid 64 which flows through the third conduit 68 to the first conduit 56 and results in a discharge of the liquid stream from the nozzle 24.

Fire suppression systems as well as other emitter systems according to the invention using emitters as described herein and capable of discharging different types of agents in multiple modes of discharge provide great versatility and provide significant advantages over prior art systems which are limited to single modes of discharge and fewer discharge agents.

What is claimed is:

1. An emitter system, comprising:

at least one emitter, said at least one emitter comprising:

a nozzle having a nozzle inlet and a nozzle outlet;

a duct, separate from said nozzle, said duct having a duct inlet, and a duct outlet separate from and positioned adjacent to said nozzle outlet;

a deflector having a deflector surface positioned facing said nozzle outlet;

said emitter system further comprising:

a source of pressurized gas connected in fluid communication with said nozzle inlet;

a source of pressurized liquid connected with both said duct inlet and said nozzle inlet; and wherein allowing said pressurized gas to flow through said nozzle in combination with allowing said pressurized liquid to flow through said duct results in discharge of an atomized liquid-gas stream from said emitter; and wherein allowing said pressurized liquid to flow through said nozzle results in discharge of a liquid stream from said nozzle.

2. The emitter system according to claim 1, further comprising:

a first conduit providing fluid communication between said source of pressurized gas and said nozzle inlet;

a first valve positioned within said first conduit for allowing said pressurized gas to flow through said nozzle;

a second conduit providing fluid communication between said source of pressurized liquid and said duct inlet;

a second valve positioned within said second conduit for allowing said pressurized liquid to flow through said duct.

3. The emitter system according to claim 2, further comprising:

a third conduit providing fluid communication between said source of pressurized liquid and said nozzle inlet; and a third valve positioned within said third conduit for allowing said pressurized liquid to flow through said nozzle.

4. The emitter system according to claim 3, wherein said third conduit is connected to said first conduit between said first valve and said at least one emitter.

5. The emitter system according to claim 2, further comprising a plurality of additional sources of pressurized liquid connected in fluid communication with said nozzle inlet.

6. The emitter system according to claim 5, further comprising:

a respective conduit providing fluid communication between each of said additional sources of pressurized liquid and said first conduit;

a respective valve, positioned within each of said respective conduits, each said respective valve for connecting each of said additional sources of pressurized liquid in fluid communication with said first conduit.

7. The emitter system according to claim 1 further comprising a plurality of projections extending outwardly from said deflector for breaking said liquid jet discharged from said nozzle into a liquid spray.

8. The emitter system according to claim 7, wherein said projections extend substantially radially outwardly from said deflector.

9. A fire suppression system, comprising:

at least one emitter, said at least one emitter comprising:

a nozzle having a nozzle inlet and a nozzle outlet;

a duct, separate from said nozzle, said duct having a duct inlet, and a duct outlet separate from and positioned adjacent to said nozzle outlet;

a deflector having a deflector surface positioned facing said nozzle outlet;

said fire suppression system further comprising:

a source of pressurized gas connected in fluid communication with said nozzle inlet;

a source of pressurized liquid extinguishing agent connected with both said duct inlet and said nozzle inlet; and wherein allowing said pressurized gas to flow through said nozzle in combination with allowing said pressurized liquid extinguishing agent to flow through said duct results in discharge of an atomized liquid-gas stream from said emitter; and wherein allowing said pressurized liquid extinguishing agent to flow through said nozzle results in discharge of a liquid extinguishing agent stream from said nozzle outlet.

10. The fire suppression system according to claim 9, further comprising:

a first conduit providing fluid communication between said source of pressurized gas and said nozzle inlet;

a first valve positioned within said first conduit for allowing said pressurized gas to flow through said nozzle;

a second conduit providing fluid communication between said source of pressurized liquid extinguishing agent and said duct inlet;

a second valve positioned within said second conduit for allowing said pressurized liquid extinguishing agent to flow through said duct.

11. The fire suppression system according to claim 10, further comprising:

a third conduit providing fluid communication between said source of pressurized liquid extinguishing agent and said nozzle inlet; and a third valve positioned within said third conduit for allowing said pressurized liquid extinguishing agent to flow through said nozzle.

12. The fire suppression system according to claim 11, wherein said third conduit is connected to said first conduit between said first valve and said at least one emitter.

13. The fire suppression system according to claim 9, further comprising a plurality of additional sources of pressurized liquid extinguishing agent connected with said nozzle inlet.

14. The fire suppression system according to claim 13, wherein said liquid fire extinguishing agents are selected from the group consisting of water, foam, liquefied halocarbons, and water with additives which modify water's heat absorbing characteristics.

15. The fire suppression system according to claim 13, further comprising:

a respective conduit providing fluid communication between each of said additional sources of pressurized liquid extinguishing agent and said nozzle inlet;

a respective valve, positioned within each of said respective conduits, each said respective valve for allowing said pressurized liquid extinguishing agent from each of said additional sources of pressurized liquid extinguishing agent to flow through said nozzle.

16. The fire suppression system according to claim 9 further comprising a plurality of projections extending outwardly from said deflector for breaking said liquid extinguishing agent stream into a liquid spray.

17. The fire suppression system according to claim 16, wherein said projections extend substantially radially outwardly from said deflector.

* * * * *